US005673585A

United States Patent [19]

Bishop

[11] Patent Number: 5,673,585

[45] Date of Patent: Oct. 7, 1997

[54] AUTOMATED DIMPLING APPARATUS

[76] Inventor: Bob Bishop, 8 Percywright Road, Newmarket, Ontario, Canada

[21] Appl. No.: 502,645

[22] Filed: Jul. 14, 1995

[51] Int. Cl.[6] ..... B21J 13/00

[52] U.S. Cl. ..... 72/447; 72/404

[58] Field of Search ..... 72/446, 447, 448, 72/404, 418, 420, 394, 350, 347

[56] References Cited

U.S. PATENT DOCUMENTS

| | | | |
|---|---|---|---|
| 3,636,748 | 1/1972 | Hall et al. | 72/349 |
| 3,855,840 | 12/1974 | Kawano | 72/418 |
| 4,118,968 | 10/1978 | Ames | 72/344 |
| 4,708,009 | 11/1987 | Post | 72/442 |
| 5,218,901 | 6/1993 | Imanishi | 72/448 |
| 5,271,140 | 12/1993 | Futamura et al. | 72/442 |

FOREIGN PATENT DOCUMENTS

| | | | |
|---|---|---|---|
| 3935498 | 5/1991 | Germany | 72/442 |

*Primary Examiner*—David Jones
*Assistant Examiner*—John Paradiso
*Attorney, Agent, or Firm*—Riches, McKenzie & Herbert

[57] ABSTRACT

An apparatus is disclosed having one or more punching or stamping tools and a corresponding number of support tools for mating with each punching or stamping tool. The apparatus is adapted to form dimples, impressions, cuts, apertures or otherwise similarly modify the surface of a sheet metal blank, and in which the punching and support tools are both movably provided along a supporting structure formed from two elongated and parallel spaced beam members. Each beam member supports one of the punching tool, or stamping tool, and the support tool in a spaced relationship whereby the tools may be aligned and activated in punching or stamping operation to punch or stamp a portion of a blank positioned therebetween. A conveyer is provided to move the blank between the tools so that the portion of the blank to be modified is moved to a position intersecting the path of movement of the punching or stamping tool and the supporting tool. The advancement of the blank on the conveyor and/or the movement of the punching or stamping tool and the support tool along the supporting structure is controlled so that dimples, apertures, and the like may be formed at any desired portion of the blank.

16 Claims, 6 Drawing Sheets

AUTOMATED DIMPLING APPARATUS

TECHNICAL FIELD

The present invention is directed to an improved apparatus for punching, stamping or otherwise modifying the surface of a sheet metal blank, and more particularly an apparatus which permits modification of substantially any sized blank.

BACKGROUND OF THE INVENTION

Sheet metal blanks used in the production of automotive parts and the like conventionally consist of large singular or welded composite metal sheets. Such sheet metal blanks are often formed as either conventional sheet metal blanks having a uniform thickness, or alternately may be tailored blanks having portions of differing thickness or even materials. Tailored sheet metal blanks may be advantageously constructed to more closely match the strength, ductility, corrosion resistance and the like to the particular requirements of a part of the component to be formed.

In the production of components from sheet metal blanks, a production run is used to produce a number of components, and the produced components are then stacked in storage for shipment or prior to final assembly. To facilitate unstacking, and in the case of tailored blanks where portions of the blanks have differing thicknesses, it is desirable to form dimples of various sizes and shapes at spaced locations on the blank so that the components produced are stacked in a stable array with the required spacing therebetween. For the dimples to effectively separate two adjacent stacked components, the dimples formed in one blank must be positioned out of alignment with the dimples formed in each of the adjacent stacked blanks.

Given the larger sizes of sheet metal blanks currently used in automotive part construction and particularly in the case of larger tailored blanks, conventional dimpling was performed in extremely large and expensive punch presses. Conventional punch presses used in stamping dimples in a blank typically would include a number of independently operable punch dies at fixed locations for forming dimples at predetermined locations. The large size of conventional punch presses is disadvantageous in that in addition to their high costs, such press machines are comparatively slow and difficult to modify for the production of different components, reducing production efficiency. Conventional punch presses suffer further disadvantages in that there are, practically speaking, limits to the number of different locations at which stamping may be performed.

The applicant has considered forming dimples in blanks by moving the blank through relatively inexpensive C-frame punch presses (see the applicant's co-pending U.S. patent application Ser. No. 08/358,528 filed Dec. 19, 1994). The applicant has, however, appreciated that the relatively narrow throat width of C-framed punch presses limits the locations at which dimples may be formed to the peripheral edge portions of the blank. As such with larger blanks and particularly with tailored blanks, the C-frame punch press would not permit the formation of dimples at central portions of larger blanks which may otherwise be necessary to properly support the produced components in a stacked array.

SUMMARY OF THE INVENTION

Accordingly, it is an object of the present invention to provide an inexpensive punching or stamping apparatus which may be used to modify almost any portion of large sheet metal blanks.

A further object of the invention is to provide a punching and stamping apparatus for modifying the surface of a sheet metal blank which may be incorporated into a production line, and which may be rapidly adapted to produce components of different sizes and constructions.

Another object of the invention is to provide a dimpling apparatus for forming dimples in a sheet metal blank which is programmable so that no two dimples formed in subsequent blanks align when the blanks are stacked.

A further object of the invention is to provide a dimpling apparatus having a plurality of mating, stamping and support dies for simultaneously forming dimples in differing portions of a tailored sheet metal blank.

In accordance with the foregoing objects, the invention provides an apparatus having one or more punching or stamping tools and a corresponding number of support tools for mating with each punching or stamping tool to form dimples, impressions, cuts, apertures or otherwise similarly modifying the surface of a sheet metal blank. In its simplest form, both the punching or stamping tool and supporting tool are movably provided along a supporting structure formed from two elongated and parallel spaced beam members. Each beam member supports one of the punching or stamping tool and the support tool in a spaced relationship whereby the tools may be aligned and activated in punching or stamping operation to punch or stamp a portion of a blank positioned therebetween.

A conveyor moves the blank between the tools on the beam members so that the portion of the blank to be modified is moved to a position intersecting the path of movement of the punching or stamping tool and the supporting tool. In this configuration, the punching or stamping and support tools may be aligned with the portion of the blank to be modified for punching or stamping operation.

By controlling the advancement of the blank on the conveyor and/or the movement of the punching or stamping tool and the support tool along the supporting structure, dimples, apertures, and the like may be formed at any desired portion of the blank which is moved between the beam members. Further, by varying the distance of advancement of each successive blank on the conveyor and/or the movement of the tools along the beam members, the relative location at which stamping or punching of the blank may be easily altered. The ease at which the location of stamping or punching may be altered facilitates switching production to a different component, or where the punch press is used to form dimples in a blank, the offsetting of dimples formed in one blank from those formed in previous and subsequently formed components.

Accordingly, in one of its aspects the present invention resides in an apparatus for modifying the surface of a sheet blank, the apparatus comprising, press means for punching or stamping a portion of said blank, said press means including a punching and stamping tool and a support tool for mating with said punching and stamping tool, supporting means for supporting said press means comprising a pair first and second parallel spaced elongate members, said punching and stamping tool slidably mounted on said first elongate member and including a punching and stamping die and first tool drive means activatable to selectively move said punching and stamping tool along said first elongate member, said support tool slidably mounted on said second elongate member and including a support die and second tool drive means activatable to move said support tool along said second elongate member to a position wherein said support die is axially aligned with said punching and stamping die to support said portion of said blank during punching and stamping operation, conveyor means for conveying said blank in a movement in a first direction between said first and second elongate members, said conveyor means maintaining said blank in an orientation permitting substantially unhindered movement of said punching and stamping tool and said support tool thereacross during punching or stamping operation, said punching and stamping tool further including first die drive means activatable to advance said punching and stamping die in an axial direction normal to said first direction into contact with said blank, said conveyor means moving said blank in said first direction to a position wherein said first and second drive means are movable along the respective first and second elongate members into axial alignment with the portion of the blank to be punched or stamped.

In a further aspect, the present invention resides in a dimpling apparatus for modifying the surface of a tailored blank, the apparatus comprising, press means for dimpling first and second portions of a blank to be modified, said press means including first and second stamping tools and first and second support tools for mating with said first and second stamping tools respectively, supporting means for supporting said press means comprising a pair of first and second horizontal parallel spaced elongate members, magnetic conveyor means for conveying said blank in indexed movement in a first direction between said first and second elongate members, said magnetic conveyor means maintaining said blank in an orientation permitting substantially unhindered movement of said first and second stamping tools and said first and second support tools thereacross during stamping operation, said first stamping tool for dimpling said first portion of said blank and being slidably mounted on said first elongate member, said first stamping tool including a first stamping die and a first stamping tool drive means activatable to selectively move said first stamping tool along a first section of said first elongate member, said second stamping tool for dimpling said second portion of said blank and being slidably mounted on said first elongate member, said second stamping tool including a second stamping die and a second stamping tool drive means activatable to selectively move said second stamping tool along a second section of said first elongate member, said first support tool slidingly mounted on said second elongate member and including a first support die and a first support drive means activatable to selectively move said first support tool along a first section of said second elongate member, said first section of said second elongate member being substantially coterminous with said first section of said first elongate member wherein said first support die is movable to a position axially aligned with said first stamping die to support said first portion of said blank during stamping operation, said magnetic conveyor moving said blank in said first direction to a position wherein said first stamping tool and said first support tool are movable along said respective first sections of said first and second elongate members into alignment with said first portion of said blank, said second support tool slidably mounted on said second elongate member and including a second die and a second support drive means activatable to selectively move said second support tool along a second section of said second elongate member, said second section of said second elongate member being substantially coterminous with said second section of said first elongate member wherein said second support die is movable to a position axially aligned with said second stamping die to support said second portion of said blank during stamping operation, said first stamping tool including first stamping die drive means activatable to advance said first stamping die in a first vertical direction into contact with said first portion of said blank, said second stamping tool including second stamping die drive means activatable to advance said second stamping die in a vertical direction into contact with said second portion of said blank.

BRIEF DESCRIPTION OF THE DRAWINGS

Further objects and advantages of the invention will appear from the following description taken together with the accompanying drawings in which.

DETAILED DESCRIPTION OF PREFERRED EMBODIMENTS

Figure 1:
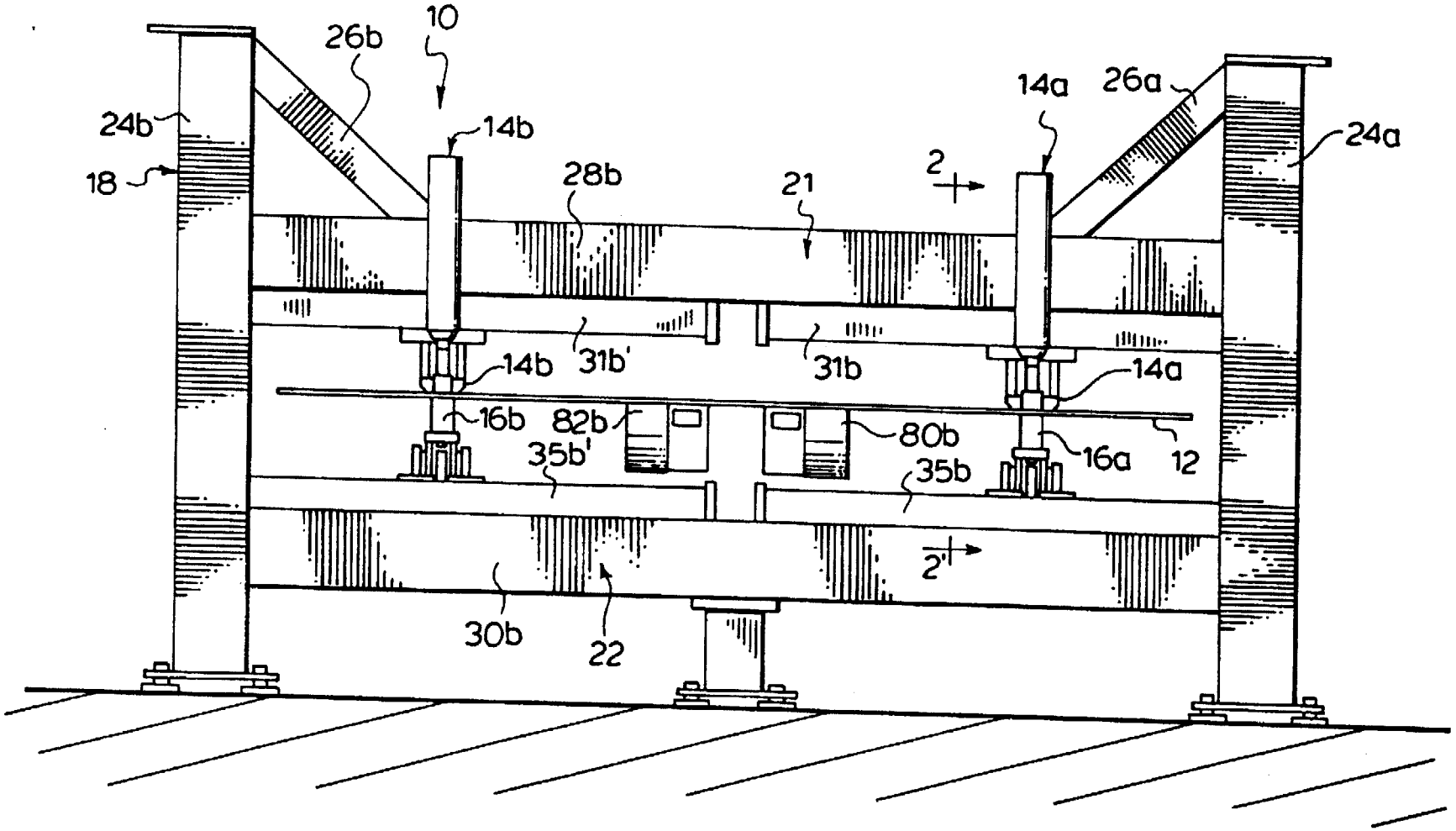
FIG. 1 is a schematic partially cutaway front view of a dimpling apparatus in accordance with a preferred embodiment of the invention.
Figure 2:
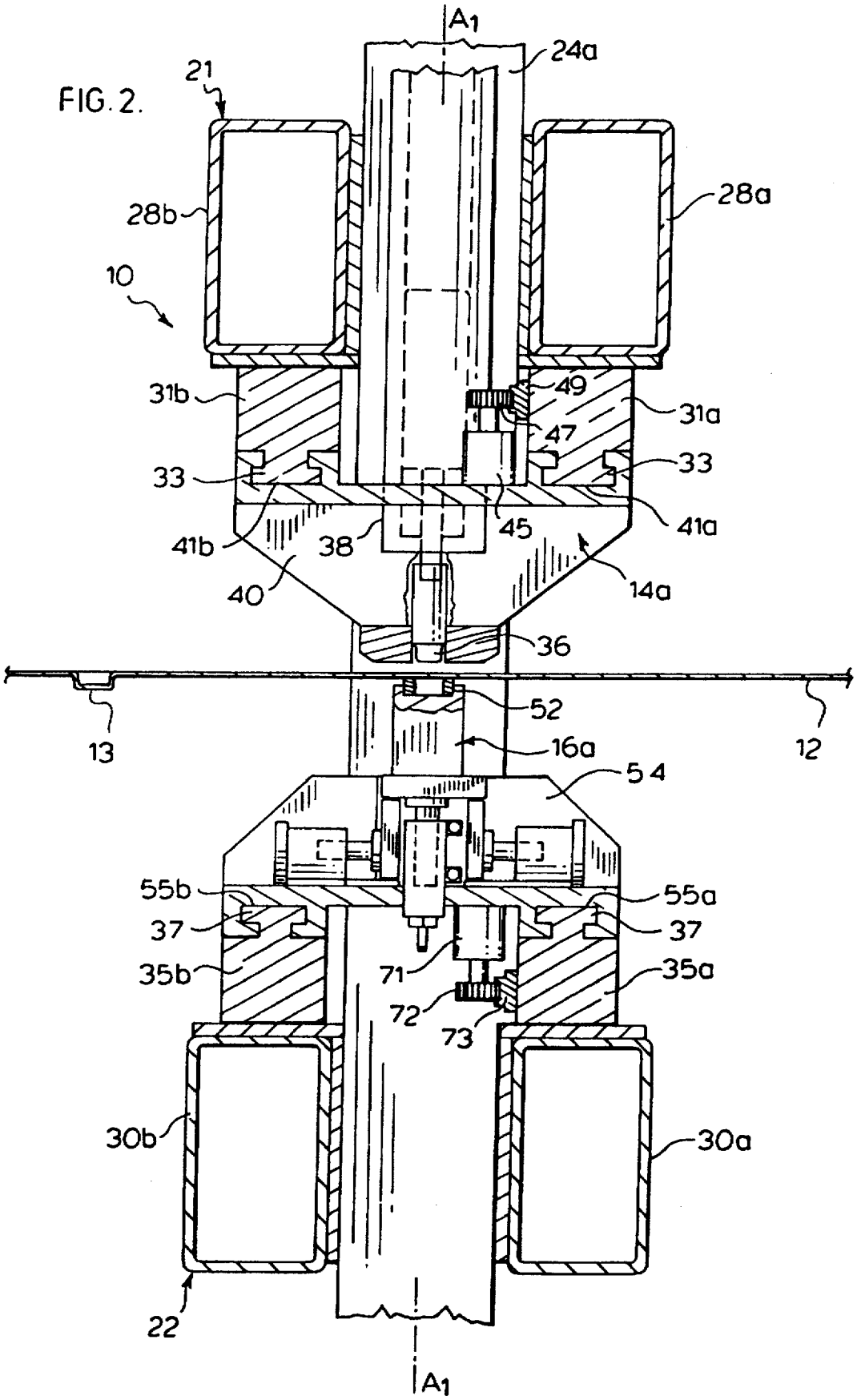
FIG. 2 is an enlarged partial cross-sectional side view of the dimpling apparatus of FIG. 1 taken along line 2—2.
Figure 3:
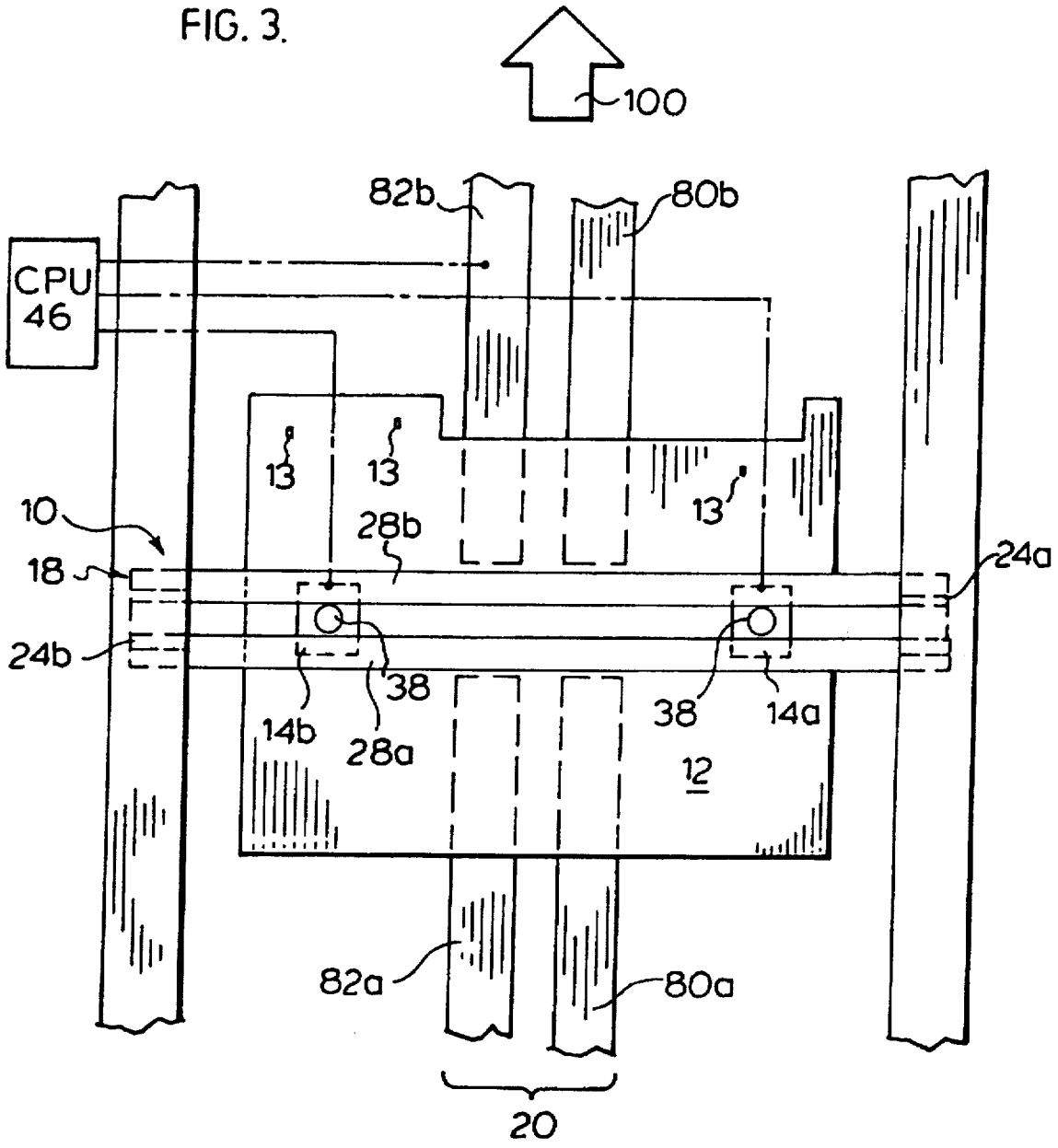
FIG. 3 is a schematic top view of the dimpling apparatus of FIG. 1 showing the insertion of a sheet metal blank therein.

FIGS. 1 to 3 show a preferred embodiment of an apparatus 10 for use in forming dimples in a tailored sheet metal blank 12. As will be described later, the dimpling apparatus 10 is adapted to be assembled as an individual work station of an automated production line used to produce custom components from the tailored blanks 12 through a series of steps.

The dimpling apparatus 10 includes a movable punch press for stamping dimples 13 in the blank 12, a rigid steel supporting structure 18 for movably supporting the punch press and a magnetic conveyor 20 for conveying the blank 12 to the punch press. In the embodiment shown, the punch press comprises two stamping tools **14*a*,14*b* and two support tools 16*a*,16*b*, which as will be described in detail hereafter, cooperate with each other in stamping operation to simultaneously form dimples 13 in the blank 12**.

The supporting structure 18 is formed having elongated upper and lower boom members 21,22 fixedly mounted at each end to two spaced vertically oriented rectangular steel supports 24a,24b. The boom members 21,22 are positioned in a parallel and spaced apart juxtaposed relation with the upper boom member 21 positioned vertically directly above the lower boom member 22. Steel brace beams 26a,26b are provided to further couple the upper boom member 21 to an upper portion of each respective support 24a,24b to provide the apparatus 10 with additional structural integrity during pressing operations.

FIG. 2 shows best the boom members 21,22 as each being constructed from a respective pair of rectangular steel beams 28a,28b and 30a,30b which extend longitudinally the width of the supporting structure 18. The beams 28a,28b and 30a,30b of each respective boom member 21,22 are juxtaposed with and parallel to the other, horizontally spaced therefrom. Each beam 28a,28b,30a,30b is connected at each end to a corresponding side surface of support 24a and support 24b by bolts or like mechanical fasteners.

Two longitudinally spaced and extending sliding tracks 31b,31b' are bolted and doweled in an aligned orientation to respective halves of a lower surface of beam 28b. In a corresponding manner, two similarly spaced and extending sliding tracks 31a,31a' bolted and doweled to a lower surface of beam 28a (only 31a shown), are each parallel to and generally coterminous with a lateral spaced one of the sliding tracks 31b,31b'. Each laterally adjacent pair of sliding tracks 31a,31b and 31a',31b' extends downwardly from the beams 28a,28b and supports a respective one of the stamping tools 14a,14b slidably therealong. The sliding tracks 31 each include in their lowermost surfaces, a longitudinally extending T-shaped projection 33 which, as will be described hereafter, is sized for slotted insertion within complementary shaped slots formed in the stamping tools 14a,14b.

Two upwardly extending longitudinally spaced sliding tracks 35b,35b' are secured to respective halves of an upper surface of beam 30b in alignment by bolts and dowels. Similarly spaced and extending sliding tracks 35a,35a' (not shown) are bolted and doweled to the upper surface of beam 30a parallel to and generally coterminous with a laterally spaced one of the sliding tracks 35b,35b'. Each laterally adjacent pair of sliding tracks 35a,35b and 35a',35b' supports a respective one of the support tools 16a,16b slidably therealong. Each sliding track 35 has formed along an uppermost surface a longitudinally extending T-shaped projection 37 sized for slotted insertion within complementary shaped slots formed in the support tools 16a,16b.

For clarity, FIG. 2 shows one stamping tool 14a and one support tool 16a mounted to adjacent pairs of sliding tracks 31a,31b and 35a,35b, which are attached to the respective upper and lower boom members 21,22. Stamping tool 14b and support tool 16b are operable in the same manner as stamping tool 14a and support tool 16a respectively have an identical construction with like reference numerals identifying like components.

Stamping tool 14a includes a stamping die 36 and a die housing 40. The stamping die 36 has a configuration selected to form a dimple having the desired shape and depth in the blank 12 and is preferably of a modular installation permitting the simplified replacement of the die with different dies for performing different punching or stamping operations. The stamping die 36 is housed within a central portion of the die housing 40 whereby in stamping operation, the die 36 is located at the longitudinal center of the upper boom member 21.

The die housing 40 is horizontally slidable along one half of length of the boom 21 on one horizontally adjacent pair of sliding tracks 31a,31b. The die housing 40 is symmetrically formed about the longitudinal center of the upper boom member 21 and includes two upwardly opening T-shaped slots 41a,41b, which are sized and spaced to slidably receive therein the corresponding T-shaped projection 33 of the sliding tracks 31a,31b. The fitted engagement of the T-shaped projections 33 into the respective slots 41a,41b slidably couples the die housing 40 to and firmly against the lowermost surface of the upper boom member 21, in a position straddling the flat bottom surfaces of each of the rectangular steel beams 28a,28b.

The die housing 40 is movable in the longitudinal direction along the tracks 31a,31b, by the activation of a motor 45 which is coupled to the housing 40. The motor 45 includes a pinion gear 47 which engages a horizontally extending rack 49 secured to the inner vertical side of the sliding track 31a. The motor 45 is operated by a computer signal provided by a computer (CPU) 46 to move the tool 14a until the die 36 is at desired position along the boom member 21.

The stamping die 36 is mounted within the die housing 40 for reciprocal vertical movement on a lowermost end of a hydraulic drive unit 38. In stamping operation, the die 36 is vertically lowered from the die housing 40 by the activation of the hydraulic drive unit 38 to move the stamping die 36 against the blank 12 and press a dimple therein. By the symmetrical construction of the die housing 40 and the central placement of the die 36, the die 36 and hydraulic drive unit 38 are maintained in axial alignment with, and are movable along, the central vertical axis $A_1$ of each of the upper and lower boom members 21,22 and the vertical supports 24a,24b. The use of a die housing 40 having the foregoing construction advantageously distributes load forces during stamping operations evenly to both beam 28a and beam 28b centrally along the supporting structure 18.

Figure 4:
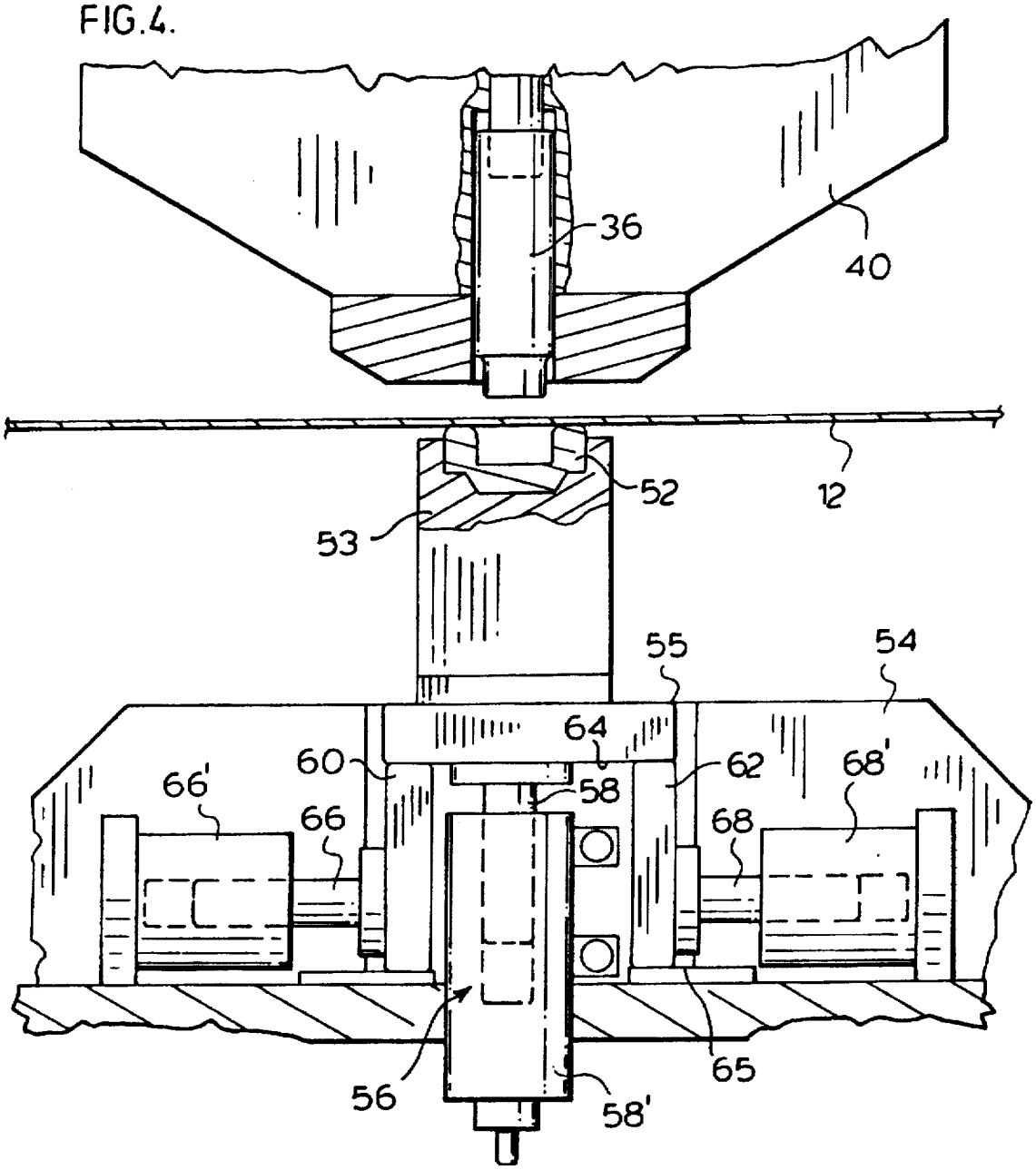
FIG. 4 is an enlarged partial schematic view of a blank, stamping tool and support tool used in the apparatus of FIG. 1 prior to stamping operation.

The support tool 16a shown best in FIGS. 2 and 4 includes a support die 52, a steel housing member 53 and a die housing 54. The support die 52 has a shape and size selected for complementary mated operation with the stamping die 36 and is preferably threadedly coupled to the housing member 53 in a modular installation, permitting the ready adaptation of the apparatus 10 for different stamping or punching operations. The support die 52 is mounted so as to be located at a central portion of the die housing 54, whereby during stamping operation the die 52 aligns with each of the stamping die 36, the longitudinally central portion of the lower boom member 22, and the axis $A_1$.

The die housing 54 is horizontally slidable along one-half of the length of the lower boom member 22 directly under the path of movement of the stamping tool 14a. The die housing 54 is symmetrically formed about the longitudinal center of the lower boom member 22, and includes two downwardly opening T-shaped slots 55a,55b. The slots 55a,55b are sized and spaced to slidably receive therein the T-shaped projection 37 of each respective sliding track 35a,35b. The fitted engagement of the T-shaped projections 37 into the slots 55a,55b slidably coupling the die housing 54 to and firmly against the uppermost surface of boom member 22, in a position straddling the flat upper surfaces of each steel beam 30a,30b.

By the movement of the die housing 54 along the tracks 35a,35b, the support die 52 may be positioned vertically aligned underneath the stamping die 36 for mated operation therewith. The die housing 54 moves along the longitudinal direction of the boom member 22 by the operation of a motor 71 which is coupled thereto. The motor 71 includes a pinion gear 72 which engages a horizontally extending rack 73 welded to the inner vertical side of slide track 35. The motor 71 and pinion 72 are preferably provided as slave drive units to each of the motor 45 and pinion 47. In this configuration both the stamping tool 14*a* and support tool 16*a* move simultaneously as a single unit along the supporting structure 18. Alternately, the motors 45,71 may be operated independently, or other types of traction drive units used which operate in response to computer control signals.

Figure 6:
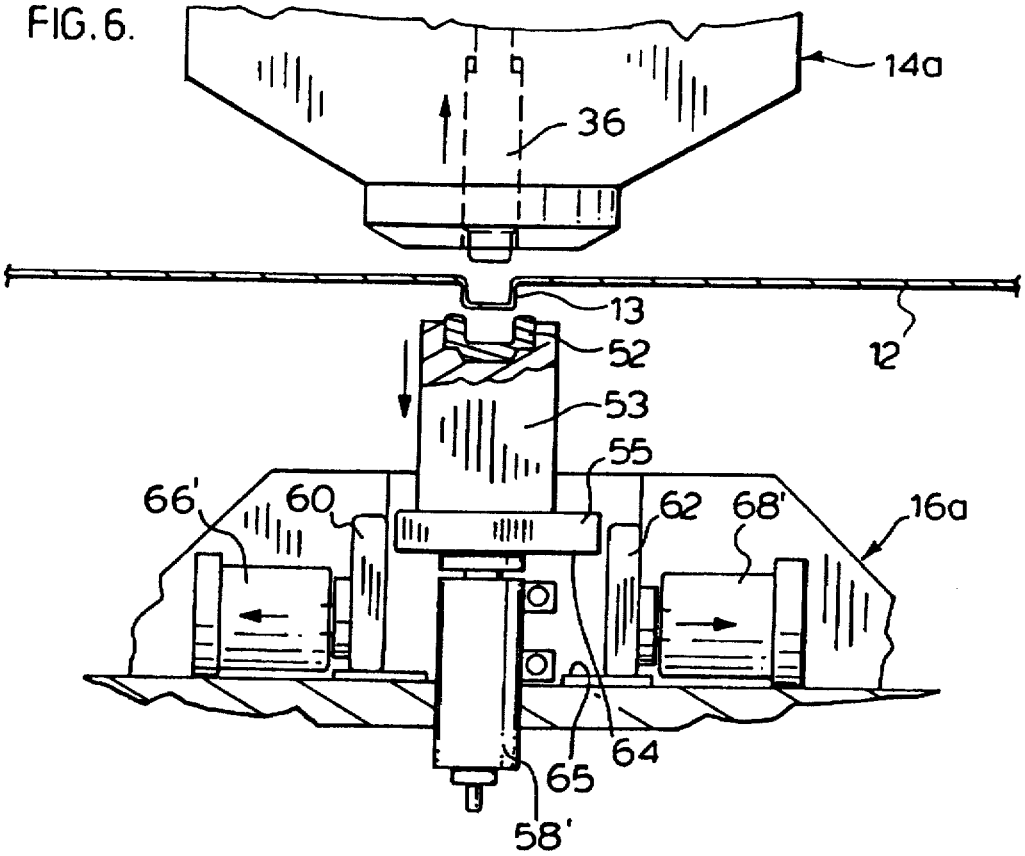
FIG. 6 shows the blank, stamping tool and support tool of FIG. 4 with the stamping tool and support tool retracted following stamping operation.

The support die 52 is vertically movable between a raised support position shown in FIG. 4, in which the support die 52 engages and supports the lower surface of the blank 12 during stamping operation, and the lowered retracted position shown in FIG. 6 where the die 52 is moved downwardly, clear of any dimples 13. The movement of the support die 52 to the retracted position advantageously moves the die 52 vertically downward, out of contact with a dimple 13 which has been formed in the blank 12 and which might otherwise interfere with component production.

Figure 5:
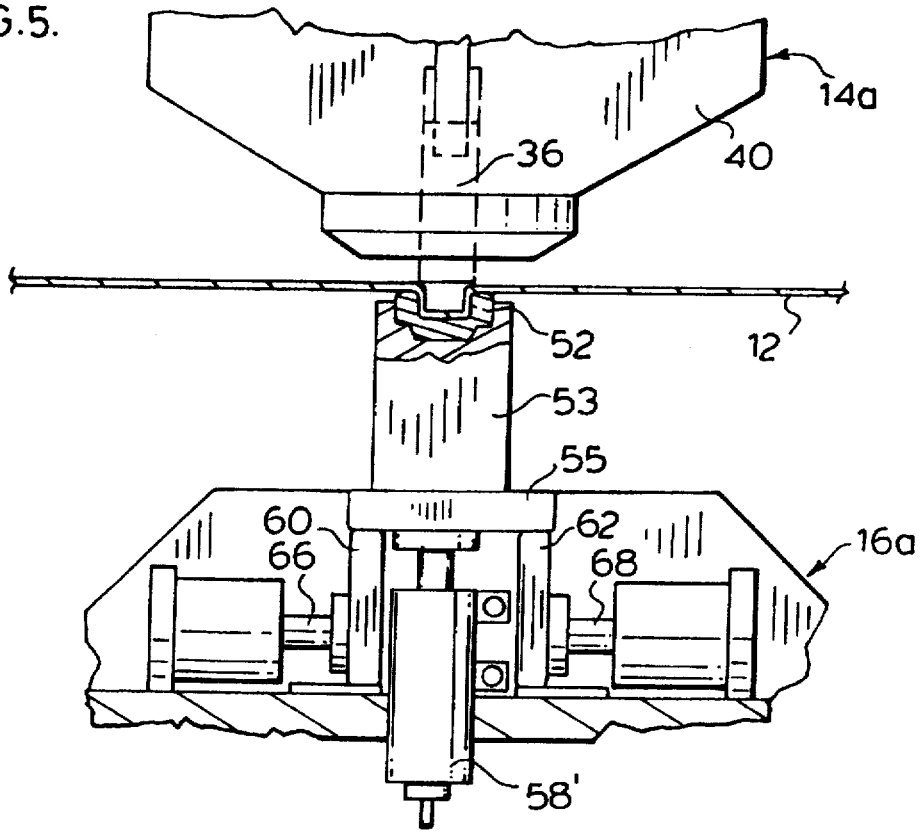
FIG. 5 shows the blank, stamping tool and support tool of FIG. 4 with the stamping tool extended to form a dimple.

The support die 52 is movable into and from the retracted position by the selective activation or deactivation of the hydraulic support unit 56 shown best in FIGS. 4 to 6. The support die 52 and housing member 53 are secured to a movable base 55. The support die 52, housing member 53 and base 55 move together as a single unit along a vertical axis into the support position by the vertical extension of hydraulic cylinder 58, operable by hydraulic drive unit 58'. Once the die 52 is raised to the support position, two laterally extensible steel brace blocks 60,62, each sized for placement between a lower surface 64 of the base 55 and an underlying portion of the die housing 65, are moved via respective hydraulic cylinders 66,68 to the bracing position shown in FIG. 4. During stamping operation, the engagement of the brace blocks 60,62 with the lower surface 64 and portion 65 provides sufficient support so that the die 52 remains in the correct support position under downward forces applied by the downward pressure of the die 36.

On completion of the stamping operation, in the manner shown in FIG. 6, the hydraulic cylinders 66,68 are retracted by drive units 66',68', withdrawing the brace blocks 60,62 from underneath the lower base surface 64. The hydraulic cylinder 58 is then retracted by hydraulic drive unit 58', to lower the support die 52 until it is moved clear of the dimple 13 which has been formed in the blank 12.

The housing 40 and housing 54 have a size selected to support the respective stamping die 36 and support die 52 in a spaced relation, and permit a horizontally oriented blank 12 to be inserted therebetween. Housing 40 and housing 54 are further configured so that on activation of the punch press into stamping operation, the stamping die 36 is lowered to contact and form the desired dimple in a portion of the blank 12, while the support die 52 provides the necessary support to the portion of the blank 12 which is engaged by the stamping die 36.

It is to be appreciated that the stamping tool 14*a* is slidably movable over approximately one-half of the boom member 21 with the support tool 16*a* movable along a corresponding portion of the boom member 22. The stamping tool 14*b* is slidably movable over the other remaining one-half of the boom member 21 with the support tool 16*b* movable thereunder. As with the tools 14*a*,16*a*, both the stamping tool 14*b* and support tool 16*b* are slidable along a respective other pair of sliding tracks 31*a*',31*b*' and 35*a*'35*b*', with a motor, pinion and rack arrangement corresponding to those shown with reference to tools 14*a*,16*a*.

The stamping tools 14*a*,14*b* together with their associated support tools 16*a*,16*b* may move either in concert or independently in response to signals produced by the central processing unit 46.

The conveyor 20 conveys a horizontally positioned blank 12 between the stamping tools 14*a*,14*b* and support tools 16*a*,16*b* at a height so that the blank 12 rests on the support tool dies 52 when they are moved to support position during stamping operations. Although not important in punching operations, to maintain optimal stability of the blank 12 on the conveyor 20, it is preferable that the dimples not be formed in the portion of the blank 12 which is directly supported by the conveyor 20. In this manner, the conveyor 20 is preferably as narrow as possible and may be a magnetic conveyor which by magnetic attraction better retains the blank 12 thereon. FIG. 3 shows best the conveyor 20 as consisting of two pairs of aligned magnetic conveyor tracks 80*a*,80*b* and 82*a*,82*b* which are spaced slightly apart so as to more stably support a central portion of a tailored blank 12. It is to be appreciated that the end of each conveyor track 80*a*,82*a* is separated from the end of the respective aligned conveyor track 80*b*,82*b* by a distance sufficient to permit the unhindered movement of the support tools 16*a*,16*b* therebetween.

The conveyor 20 moves the blank 12 in the horizontal direction of arrow 100, which is perpendicular to the direction of longitudinal movement of the stamping tools 14*a*,14*b* and supporting tools 16*a*,16*b* along the respective upper and lower boom members 21,22. The conveyor 20 moves the blank 12 in the direction of arrow 100 in response to a conveyor signal provided from the central processing unit or computer 46 until the portion of the blank 12 which is to have dimples 13 formed therein is aligned with the longitudinal center of the boom members 21,22. In this manner, the portion of the blank 12 which is to be modified is moved by the conveyor 20 into the path of longitudinal movement of both the die 36 of stamping tool 14*a* and/or the stamping tool 14*b* and the die 52 of the associated support tool 14*a*,14*b*, so that either or both stamping dies 34 and the corresponding mating support die 52 may be positioned in vertical alignment therewith.

By the use of a computer 46 to control both movement of the blank 12 on the conveyor 20, and the movement of the punch press tools 14*a*,14*b*,16*a*,16*b* along the supporting structure 18, successive dimpling locations may be preprogrammed so that the dimples 13 of no two blanks 12 precisely align.

With the configuration of the present apparatus, stamping operations may be performed almost anywhere on the portion of blank 12 which is moved between the upper and lower boom members 21,22. To provide the stamping tools 14 with the flexibility to perform other stamping or punching functions the hydraulic cylinder 38 preferably is also controlled by the computer 46 and has a stroke length which is adjustable. By adjustment of the stroke length of the hydraulic cylinder 38 and the selection of the stamping die, the apparatus 10 may be easily converted for different punching or stamping operations.

It is to be appreciated that a dimpling apparatus 10 of the present construction may be used with extremely large blanks 12 simply by extending the lengths of the boom members 21,22 and the corresponding sliding tracks 31,35.

Figure 7:
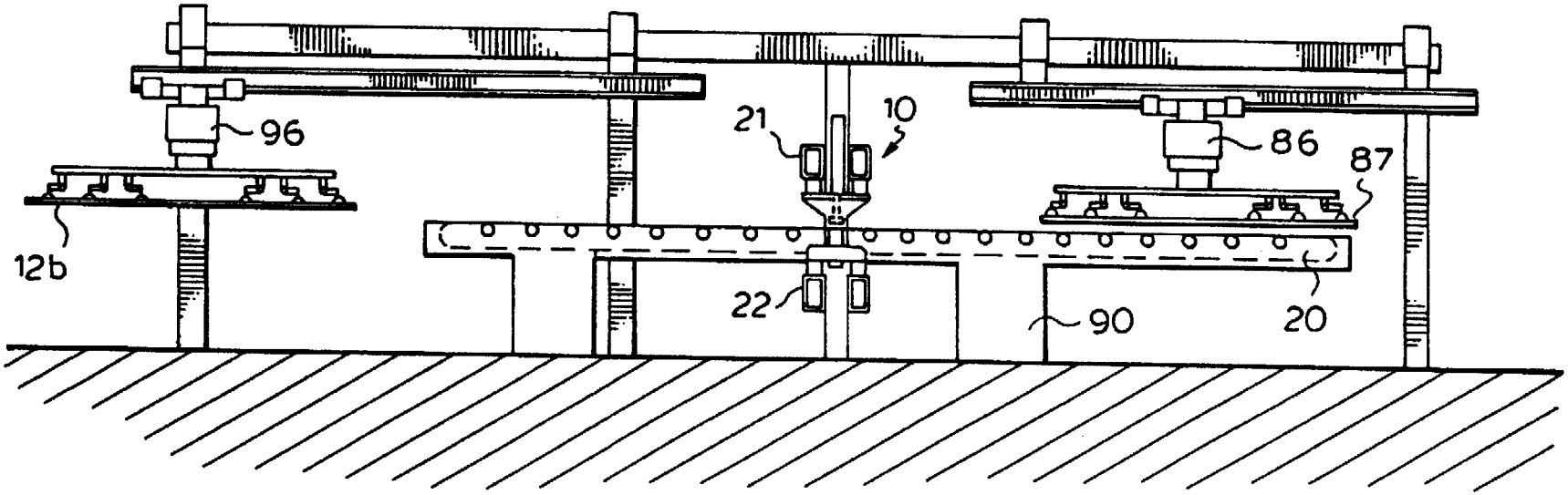
FIG. 7 is a schematic side view of an assembly line for producing a finished blank showing the dimpling apparatus of FIG. 1 installed therein.

FIG. 7 illustrates the process by which a finished tailored blank 12*b* is assembled, dimpled and stacked through an assembly apparatus. At a blank assembly station, components are positioned on the magnetic conveyor 20 and conveyed in a stepped matter from right to left.

An input robot 86 is used to transfer the various sheet metal component parts from respective input stacks. The sheet parts are next conveyed by the magnetic conveyor 20 through a welder station 90 to form a welded steel blank. The conveyor 20 next advances the welded steel blank to the position on the conveyor 20 shown in FIG. 4, with the blank 12 between the upper and lower boom members 21,22 of the dimpling apparatus 10. So positioned, the portion of the blank 12 to be dimpled is located along the path of movement of the stamping tools 14*a*,14*b* and support tools 16*a*,16*b*.

The conveyor 20 is controlled by a computer control signal to advance the distance the blank 12 between the boom members 21,22, so that the portion of the blank 12 to have a dimple formed therein does not coincide with the dimpled portion of the previous blank. Simultaneously with the advance of the blank 12 on the conveyor 20, the computer processor provides a signal to activate each of the drive motors 45,71, the respective stamping tools 14*a*,14*b* and support tools 16*a*,16*b*. The tools 14*a*,14*b*,16*a*,16*b* are moved in response to the computer signal so that each mating stamping die 36 and support die 52 is positioned along the respective upper and lower boom members 21,22 above each of the portions of the blank 12 to be dimpled.

The formation of dimples 13 in adjacent halves of the blank 12 may occur simultaneously or independently. Dimples 13 are formed with the portion of the blank 12 in the manner described with reference to FIGS. 4 to 6. The support die 52 is moved upwardly to contact and support the blank 12 by raising the hydraulic cylinder 58. The support die 52 is then braced in the supporting position by the brace blocks 60,62 in the manner previously described. The vertically aligned hydraulic cylinder 38 is then lowered to perform the stamping operation, moving the stamping die 36 against the blank 12, pressing part of the blank into the support die 52 to form the dimple 13.

After stamping, the stamping die 36 is retracted by the return upward movement of the cylinder 38. The brace blocks 60,62 are simultaneously withdrawn and support die 52 is lowered to a position spaced beneath the formed dimple 13 by the lowering of hydraulic cylinder 58. Each associated pair of stamping and support tools 14*a*,16*a*, and 14*b*,16*b* then move in response to a next control signal from the computer 46 to a position for the next dimpling operation.

The dimpled welded blank 12*b* is thereafter conveyed by the magnetic conveyor 20 to an output stacking machine 96. The completed blanks 12*b* are lifted from the conveyor 20 by the stacking machine 96, and are transferred to output stacks. The stacking machine 96 may for example be an overhead gantry crane shuttling between the end of the conveyor 20 and output stacks.

Along the length of the magnetic conveyor 20 may also be a series of other work stations to perform further processing operations on the welded blanks 12 such as oil spraying, grinding or the like. It will be understood that each of the further operations may be bypassed or selected as required by the design and specifications of the blank 12 to be manufactured. It will also be understood that the welding, dimpling and processing of blanks 12 is continuous with blanks 12 conveyed in series along the length of the conveyor 20.

While the preferred embodiment shows a punch press comprising two pairs of cooperating stamping tools 14*a*,14*b* and support tools 16*a*,16*b*, the invention is not so limited. Any number of pairs or combinations of stamping tools and support tools may be provided movable along all or part of the length of the supporting structure.

Although the preferred embodiment of the invention as described in apparatus 10 forming dimples in sheet metal blank 12, the apparatus 10 may equally be modified to perform other punching or stamping operations including the stamping of other indentations in blanks or the punching of cuts or apertures. In this matter, modifications to the blank may be selectively programmed via the computer processor 46 providing the apparatus with a high degree of flexibility and eliminating down time and machine modifications when converting the apparatus to produce differing components.

While the disclosure teaches an apparatus in which each of the stamping tools slidable along its own respective pair of sliding tracks 31*a*,31*b* and 35*a*,35*b*, it is to be appreciated that both the stamping tools and/or both support tools 16 could be also provided on a single sliding track extending the entire length of the supporting structure, or slidably mounted to the supporting structure of an entirely different configuration. If a single or other sliding track is to be used, the stamping and/or support tools may further be adapted for movement along either discrete or overlapping portions of the sliding track.

Although the detailed description describes preferred embodiments of the invention, it is to be understood that the invention is not so limited. Modifications and variations will now become apparent to persons skilled in this art. For a more precise definition of the invention, reference may be had to the appended claims.

We claim:

1. An apparatus for modifying the surface of a sheet blank, the apparatus comprising, dimple stamping means for stamping a dimple in a portion of said blank, said dimple stamping means including a stamping tool, and a support tool for mating with said stamping tool and engaging and supporting said portion of said blank during stamping, support means for supporting said dimple stamping means comprising a pair first and second parallel spaced elongate members, said stamping tool slidably mounted on said first elongate member and including a stamping die, first tool drive means activatable to selectively move said stamping tool along said first elongate member and first die drive means, said support tool slidably mounted on said second elongate member and including a support die, second tool drive means activatable to move said support tool along said second elongate member to a position wherein said support die is axially aligned with said stamping die to support said portion of said blank during stamping operation, and second die drive means, conveyor means for conveying said blank in a first direction between said first and second elongate members, said conveyor means maintaining said blank in an orientation permitting substantially unhindered movement of said stamping tool and said support tool thereacross during punching or stamping operation, said first die drive means being activatable to advance said stamping die in an axial direction normal to said first direction into contact with said blank, said second die drive means being activatable to retract said support die in said axial direction away from said blank to a position spaced from said dimple, and said conveyor means for moving said blank in said first direction to a position wherein said first and second tool drive means are movable along the respective first and second elongate members into axial alignment with the portion of the blank to be stamped.

2. An apparatus as claimed in claim 1 wherein said stamping tool and said support tool are movable along said respective first and second elongate members in a second direction transverse to said first direction.

3. An apparatus as claimed in claim 1 wherein said conveyor means comprises a magnetic conveyor.

4. An apparatus as claimed in claim 1 wherein said conveyor means operates to convey said blank in said first direction in response to a conveyor signal, said apparatus further including computer processing means connected to said conveyor means for supplying said conveyor signal to control the movement of said blank between said first and second elongate members.

5. An apparatus as claimed in claim 4 wherein said stamping tool and said support tool are movable along said respective first and second elongate members in response to associated drive signals, said computer processing means being further connected to said first and second drive means and supplying said drive signals to control movement of said stamping tool and said support tool along said respective first and second elongate members.

6. An apparatus as claimed in claim 5 wherein said first and second elongate members are positioned in a generally horizontal orientation, said stamping die being axially aligned under a medial portion of said first elongate member, and said support die being axially aligned above a medial portion of said second elongate member.

7. An apparatus as claimed in claim 1 wherein said first die drive means comprises a hydraulic drive mechanism including a telescopingly movable drive shaft movable in a forward, axial direction towards said blank, said stamping die being located at a forwardmost end portion of said drive shaft.

8. An apparatus as claimed in claim 1 wherein said first and second elongate members are positioned in a horizontal orientation, said stamping die being axially aligned under a medial portion of said first elongate member, and said support die being axially aligned above a medial portion of said second elongate member.

9. The use of the apparatus of claim 1 by the steps of:

activating said conveyor means to convey said blank in said first direction to a first position wherein said portion of said blank to be modified is moved between said first and second elongate members, activating said first and second tool drive means to move said respective stamping die and said support die along said respective first and second elongate members to a position axially aligned with said portion of said blank to be punched or stamped, with said stamping die and said support die axially aligned with said portion of said blank, activating said first die drive means to advance said stamping die into contact with said portion of said blank to form said dimple, and keeping the blank in a substantially fixed position while retracting the support die to said position spaced from said dimple.

10. The use of the apparatus of claim 5 by the steps of:

outputting a first drive signal from said computer processing means to said conveyor means to initialize said conveyor means and move said blank in said first direction to a first position wherein said portion of said blank to be stamped is substantially moved in between said first and second elongate members, outputting second drive signals from said computer processing means to each of said first and second tool drive means to initialize said respective tool drive means and move said stamping tool and said support tool along said first and second elongate members to a position where said stamping die and said support die are axially aligned with said portion of said blank to be stamped, with said punching and stamping die and said support die aligned with said portion of said blank, activating said first die drive means to advance said stamping die into contact with said portion of said blank to form said dimple, and keeping the blank in a substantially fixed position while retracting the support die to a position spaced from said dimple.

11. A dimpling apparatus for modifying the surface of a tailored blank, the apparatus comprising, press means for dimpling first and second portions of a blank to be modified, said press means including first and second stamping tools and first and second support tools for mating with said first and second stamping tools respectively, supporting means for supporting said press means comprising a pair of first and second horizontal parallel spaced elongate members, magnetic conveyor means for conveying said blank in indexed movement in a first direction between said first and second elongate members, said magnetic conveyor means maintaining said blank in an orientation permitting substantially unhindered movement of said first and second stamping tools and said first and second support tools thereacross during stamping operation, said first stamping tool for dimpling said first portion of said blank and being slidably mounted on said first elongate member, said first stamping tool including a first stamping die and a first stamping tool drive means activatable to selectively move said first stamping tool along a first section of said first elongate member, said second stamping tool for dimpling said second portion of said blank and being slidably mounted on said first elongate member, said second stamping tool including a second stamping die and a second stamping tool drive means activatable to selectively move said second stamping tool along a second section of said first elongate member, said first support tool slidingly mounted on said second elongate member and including a first support die and a first support drive means activatable to selectively move said first support tool along a first section of said second elongate member, said first section of said second elongate member being substantially coterminous with said first section of said first elongate member wherein said first support die is movable to a position axially aligned with said first stamping die to support said first portion of said blank during stamping operation, said magnetic conveyor moving said blank in said first direction to a position wherein said first stamping tool and said first support tool are movable along said respective first sections of said first and second elongate members into alignment with said first portion of said blank, said second support tool slidably mounted on said second elongate member and including a second support die and a second support drive means activatable to selectively move said second support tool along a second section of said second elongate member, said second section of said second elongate member being substantially coterminous with said second section of said first elongate member wherein said second support die is movable to a position axially aligned with said second stamping die to support said second portion of said blank during stamping operation, said first stamping tool including first stamping die drive means activatable to advance said first stamping die in a first vertical direction into contact with said first portion of said blank, said second stamping tool including second stamping die drive means activatable to advance said second stamping die in a vertical direction into contact with said second portion of said blank, and wherein said first support tool further includes first support die drive means activatable to retract said first support die in a vertical direction to a position spaced from said first portion of said blank, and second support tool includes second support die drive means activatable to retract said second support die in a vertical direction to a position spaced from said second portion of said blank.

12. A dimpling apparatus as claimed in claim 11 wherein said first and second sections of said first elongate member overlap.

13. A dimpling apparatus as claimed in claim 11 wherein said first and second stamping tools are configured for simultaneous stamping operation.

14. A dimpling apparatus as claimed in claim 11 wherein said first and second stamping tools are configured for independent stamping operation.

15. A dimpling apparatus as claimed in claim 11 wherein said magnetic conveyor means conveys said blank in said first direction in response to a conveyor signal, said dimpling apparatus further including computer processing means electronically connected to said conveyor means for supplying said conveyor signal to control said indexed movement of said blank between said first and second elongate members.

16. A dimpling apparatus as claimed in claim 11 wherein said first stamping tool is movable along said first section of said first elongate member in response to a first stamping tool signal, and said second stamping tool is movable along said second section of said first elongate member in response to a second stamping tool signal, said dimpling apparatus further including computer processing means electronically connected to said first and second stamping tools for supplying said respective first and second stamping tool signals to control movement of said first and second stamping tools along said first and second elongate members.

* * * * *